United States Patent [19]

Otte et al.

[11] Patent Number: 4,919,394

[45] Date of Patent: Apr. 24, 1990

[54] RAILING CONSTRUCTION

[75] Inventors: Donald R. Otte, New Berlin; Steven E. Krueger, New London, both of Wis.

[73] Assignee: Cubic Designs Inc., Milwaukee, Wis.

[21] Appl. No.: 304,709

[22] Filed: Feb. 1, 1989

[51] Int. Cl.[5] ..... E04H 17/14

[52] U.S. Cl. ..... 256/65; 256/68; 256/69; 256/59; 411/174

[58] Field of Search ..... 256/68, 69, 70, 59, 256/64, 65; 403/246, 232.1, 199, 382, 403; 411/174, 175

[56] References Cited

U.S. PATENT DOCUMENTS

| | | | |
|---|---|---|---|
| 2,382,942 | 8/1945 | Murphy | 411/174 |
| 3,195,937 | 7/1965 | Case | 256/65 X |
| 3,278,149 | 10/1966 | Brucker | 403/232.1 X |
| 3,343,811 | 9/1967 | Kusel et al. | 256/65 X |
| 3,498,589 | 3/1970 | Murdock | 256/70 |
| 3,596,880 | 8/1971 | Greenberg | 256/65 |
| 3,756,567 | 9/1973 | Murdock | 256/65 X |
| 3,848,854 | 11/1974 | De Barbieri | 256/65 |
| 3,918,686 | 11/1975 | Knott et al. | 256/59 |
| 3,942,763 | 3/1976 | Helterbrand et al. | 256/65 X |
| 4,101,226 | 7/1978 | Parisien | 256/65 X |
| 4,149,701 | 4/1979 | Densen | 403/246 X |
| 4,249,830 | 2/1981 | Day | 403/246 X |

FOREIGN PATENT DOCUMENTS

| | | |
|---|---|---|
| 2063956 | 6/1981 | United Kingdom . |
| 2173527 | 10/1986 | United Kingdom . |

*Primary Examiner*—Randolph A. Reese
*Assistant Examiner*—Carol I. Bordas
*Attorney, Agent, or Firm*—Andrus, Sceales, Starke & Sawall

[57] ABSTRACT

A railing construction comprising a plurality of upright posts, and a plurality of horizontal hollow rails having a generally rectangular cross section are connected between adjacent posts. Each rail includes a pair of side walls, a bottom wall and a top wall. Rail supporting brackets are connected to each post and each bracket includes a pair of spaced vertical side members that are disposed flatwise against the inner surfaces of the respective side walls of the rail. In addition, each bracket is provided with a horizontal lip that is disposed flatwise against the bottom wall of the rail. The end of the bottom wall of the rail has a notch having a length at least equal to the horizontal length of the side members of the brackets, so that the rail can be slipped downwardly over the bracket. The bottom wall of the rail and the horizontal lip of the bracket are provided with aligned holes which receive a bolt to connect the rail to the post.

10 Claims, 1 Drawing Sheet

FIG. 1
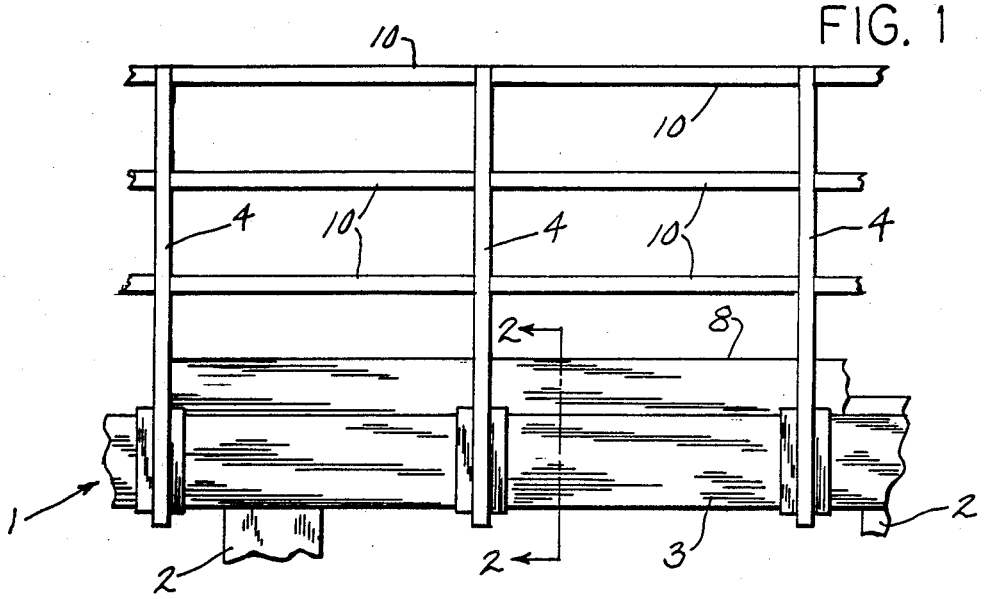
FIG. 5
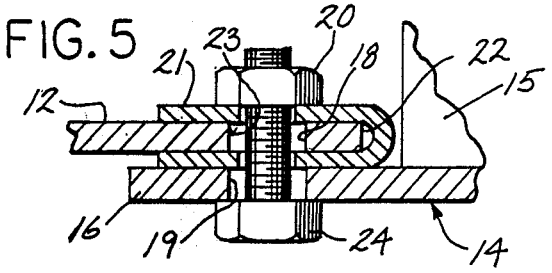
FIG. 3
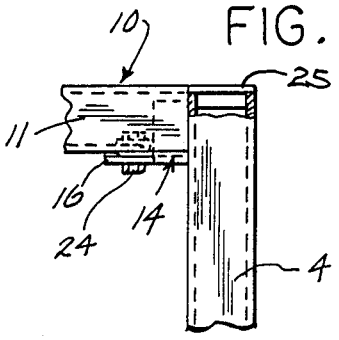
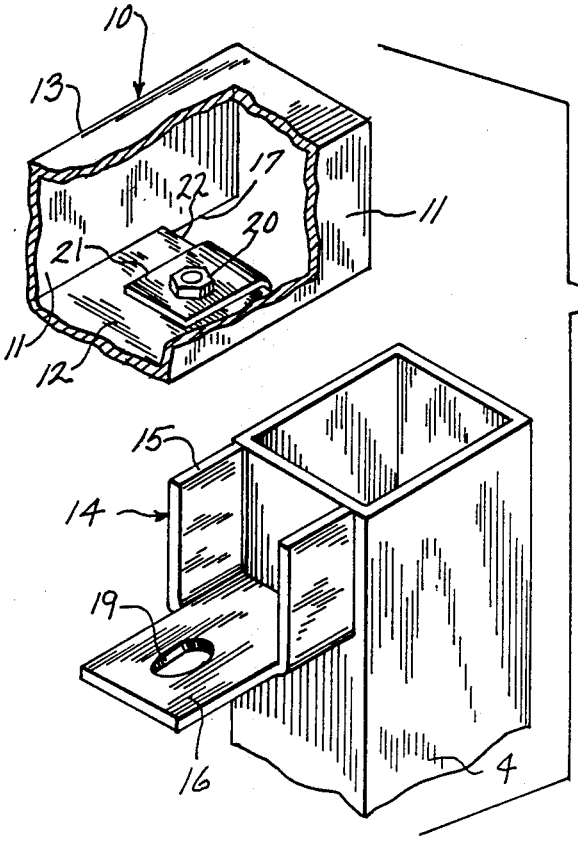
FIG. 4
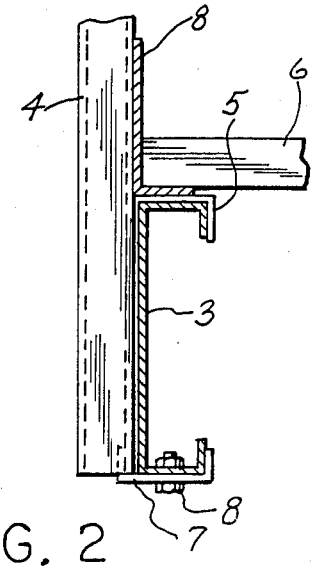
FIG. 2

RAILING CONSTRUCTION

BACKGROUND OF THE INVENTION

Mezzanines are frequently constructed in commercial or industrial establishments to increase the storage or production floor space. The typical mezzanine is supported above the foundation of the building by a series of vertical columns and includes a deck or supporting surface which is bordered by a railing. According to Federal requirements, the railing must be at least forty-two inches high and the openings between horizontal rails cannot exceed twelve inches. In the past the typical railing for a mezzanine has consisted of a series of vertical pipes which extend upwardly from the edge of the deck and cross-shaped or T-shaped fittings are located within each vertical pipe. Cylindrical rails are inserted through the horizontal openings of the cross-shaped and T-shaped fitting. With railings of this type, individual horizontal rails cannot be removed. For example, if it is desired to install or remove a relatively large piece of machinery or equipment from the mezzanine which would require the removal of a section of railing, it would be necessary to remove the entire railing, for individual sections cannot be disassembled. Thus, there has been a need for a railing construction in which individual rails can be removed from the railing.

SUMMARY OF THE INVENTION

The invention is directed to an improved railing construction that has particular use with a mezzanine. The railing construction includes a plurality of upright posts and a series of hollow horizontal rails, each having a generally rectangular cross section, are connected between adjacent posts. Each rail includes a pair of opposed side walls that are connected by a bottom wall and a top wall.

Rail supporting brackets are secured to each post and each bracket includes a pair of spaced parallel side members that are disposed flatwise against the inner surfaces of the side walls of the rail. In addition, each bracket includes a horizontal lip which is disposed flatwise against the bottom wall of the rail.

To permit the rail to be slipped downwardly over the bracket, the end of the bottom wall of the rail is provided with a notch which has a length at least equal to the horizontal length of the side members of the bracket.

Aligned holes are provided in the bottom wall of the rail and in the horizontal lip of the bracket, which receive a connecting bolt. In a preferred form of the invention, a nut is mounted on one leg of a generally U-shaped clip that is inserted over the end of the bottom wall of the rail and the clip is provided with a locator which locates the nut in axial alignment with the hole in the bottom wall. The bolt is then inserted through the aligned holes in the horizontal lip of the bracket and the bottom wall of the rail and threaded into the nut to secure the rail to the post.

The construction of the invention enables individual rails to be assembled and disassembled with respect to the supporting posts, without the necessity of disassembling the entire railing.

As both the rails and the posts have a generally rectangular cross section, the resulting railing construction has a smooth attractive appearance.

In the final construction, the upper ends of the posts are enclosed by plastic caps, which are flush with the top surface of the rails and the side walls of the rails are flush with the sides of the posts, so that there are no sharp or protruding edges in the finalized construction.

While the railing construction has particular application for use with mezzanines, it is contemplated that the railing can be used in various other applications or environments.

Other objects and advantages will appear in the course of the following description.

DESCRIPTION OF THE DRAWINGS

The drawings illustrate the best mode presently contemplated of carrying out the invention.

In the drawings:

FIG. 1 is a front elevation of a portion of the railing construction of the invention as used with a mezzanine;

FIG. 2 is a vertical section taken along line 2—2 of FIG. 1;

FIG. 3 is a fragmentary side elevation of the upper end of a post and rail;

FIG. 4 is an exploded perspective view showing the post bracket and the end of one of the rails; and FIG. 5 is an enlarged fragmentary vertical section showing the attachment of the rail to the post bracket.

DESCRIPTION OF THE ILLUSTRATED EMBODIMENT

The drawings illustrate the railing construction of the invention as associated with a mezzanine 1 that is located in a commercial or industrial establishment. Mezzanine 1 includes a plurality of vertical supporting columns 2 that rest on the foundation of the building and the upper ends of the columns support a plurality of channel-shaped frame members 3. A plurality of posts 4 extend upwardly from the channel members 3 and a generally inverted J-shaped connector 5 is welded to each post 4 and rests atop the channel member 3 and is located under the deck 6, as shown in FIG. 2. In addition, the lower end of each post is connected to the channel member by a generally C-shaped connector 7. One flange of connector 7 extends upwardly within the interior of the post, while the other flange of the connector engages the vertical lip on the channel member 3. Connector 7 is secured to the channel member by a bolt which extends through aligned openings in the members. With this construction, which forms no part of the invention, the posts are not welded to the channel members 3, but instead are connected to the channel members through the resting of connector 5 on member 3 and the connectors 7.

As shown in FIG. 2, an angle-shaped kick plate 8 is positioned with a first leg placed between the deck 6 and the member 3, and the second leg extends upwardly from the deck 6 to prevent material from accidentally falling from the deck.

A plurality of rails 10 interconnect adjacent posts 4 and each of the rails is generally rectangular in cross section, being composed of a pair of parallel side walls 11 that are connected by a bottom wall 12 and a top wall 13.

The ends of the rails 10 are connected to posts 4 by means of rail supporting brackets 14 which are secured, as by welding, to the posts 4. As shown in FIG. 4, each bracket includes a pair of parallel vertical side members 15 and in the assembled condition of the railing, the side members 15 are disposed flatwise against the inner surfaces of side walls 11 of rails 10.

In addition, each bracket includes a horizontal lip 16 which extends outwardly beyond the lower edges of side members 15, and in the assembled condition, as shown in FIG. 5, lip 16 is disposed in engagement with the undersurface of bottom wall 12 of rail 10.

To permit the rail 10 to be slid downwardly over the bracket 14, the end of the bottom wall 12 is provided with a cutout or notch 17 and the horizontal length of notch 17 is equal to or slightly greater than the horizontal length of the side members 15.

Bottom wall 12, as well as the lip 16, are provided with aligned holes 18 and 19, respectively, which are adapted to receive a bolt or fastener. In a preferred form of the invention, a nut 20 is secured, such as by welding, to one leg of a U-shaped clip 21. Prior to assembly of rail 10 with posts 4, the clip is disposed over the edge 22 of bottom wall 12 that defines notch 17 and the clip is provided with a downwardly extending projection 23 which engages the hole 18 in bottom wall 12 to thereby locate the nut 20 in axial alignment with the hole 18. A bolt 24 is then inserted through hole 19, through a hole in the lower leg of clip 21, through hole 18, through a hole in the upper leg of clip 21, and threaded in the nut 20 to thereby secure the rail to the bracket 14.

In assembling the railing, brackets 14 are initially welded at predetermined locations along the height of each post 4 and the posts are then assembled to the channel members 3. Clips 21 are then inserted on the bottom wall 12 at each end of the rail and the projections 23 serve to locate or align the nuts with respect to the holes 18. The ends of the rail 10 are then slid downwardly over the brackets 15 on posts 4 until the bottom walls 12 engage the horizontal lips 16 of the brackets. Bolts 24 are then inserted through the aligned holes and threaded with the nuts 20 to complete the assembly.

Plastic caps 25 can be inserted in the opening upper end of each post 4, and the upper surface of each cap is flush with the upper surface of top wall 13 of rail 10. In addition, the outer surfaces of side walls 11 of rail 10 are flush with opposed sides of the post. Thus, in the assembled condition there are no sharp edges or protrusions which could catch on equipment or workmen utilizing the mezzanine.

With the construction of the invention the rails 10 between any pair of adjacent posts 4 can be readily removed without disassembly of the posts or the entire railing construction.

As the posts 4, as well as rails 10, have a generally rectangular cross section. An attractive appearance is provided for the railing.

Various modes of carrying out the invention are contemplated as being within the scope of the following claims particularly pointing out and distinctly claiming the subject matter which is regarded as the invention.

I claim:

1. A railing construction, comprising a plurality of upright posts, a hollow rail having a generally rectangular cross section connected between adjacent posts, said rail including a pair of opposed side walls, a bottom wall and a top wall, a rail supporting bracket secured to each post, each bracket including a pair of spaced vertical side members extending outwardly from said post and disposed generally flatwise against the inner surfaces of the respective side walls, each bracket also including a horizontal lip having a greater horizontal length than said side members and projecting outwardly from said post between said side members and disposed flatwise against said bottom wall, said rail having an end facing a post and having a notch in said bottom wall extending from said end a horizontal distance at least as great as the horizontal length of said side members, said notch being constructed and arranged to receive said side members as said rail is slipped downwardly over said bracket, and connecting means for connecting said lip to said bottom wall.

2. The construction of claim 1, wherein said side members have a vertical height slightly less than the vertical height of said side walls.

3. The construction of claim 1, wherein said bottom wall and said lip are provided with aligned holes, and said connecting means comprises a bolt extending through said aligned holes.

4. The construction of claim 1, wherein said bottom wall and said lip are provided with aligned holes and said connecting means comprises a generally U-shaped clip straddling said bottom wall, said clip having a pair of parallel legs with each leg having an opening aligned with said holes, a nut secured to one of said legs and disposed in alignment with said holes and said openings, and a bolt disposed through said holes and said openings and threaded with said nut.

5. The construction of claim 4, and including locating means on said clip for locating said nut with respect to said aligned holes.

6. The construction of claim 5, wherein said locating means comprises a projection on one of said legs and disposed to engage the hole in said bottom wall.

7. The construction of claim 1, wherein each post has an open upper end and said construction includes a cap secured within said open end, the upper surface of said cap being substantially flush with the upper surface of said top wall.

8. A railing construction, comprising a plurality of upright hollow posts having a generally rectangular cross section, a hollow rail having a generally rectangular cross section connected between adjacent posts, said rail including a pair of opposed side walls, a bottom wall and a top wall, a rail supporting bracket secured to said posts, each bracket including a pair of spaced vertical side members extending outwardly from said post and disposed flatwise against the inner surfaces of the respective side walls of said rail, each bracket also including a horizontal lip extending outwardly from said post and disposed at the lower ends of said side members, said lip having a greater horizontal length than said side members and projecting beyond the outer ends of said side members, said lip being disposed flatwise against the bottom wall of said rail, said bottom wall and said lip having aligned openings, said rail having an end disposed in abutting relation to a surface of a post and having a notch in said bottom wall extending from said end a horizontal distance at least as great as the horizontal length of said side members, said notch being constructed and arranged to receive said side members as the rail is slipped downwardly over the bracket, and connecting means disposed within said aligned openings for connecting said rail to said bracket.

9. The construction of claim 8, and including a cap secured within the open upper end of each post, the upper surface of the cap being substantially flush with the upper surface of the top wall of the rail.

10. The construction of claim 8, wherein said connecting means comprises a bolt, said construction also including a nut disposed within said rail to receive said bolt, and positioning means for positioning said nut in alignment with said holes.

* * * * *